US006668611B2

(12) United States Patent
Kashiwazaki et al.

(10) Patent No.: US 6,668,611 B2
(45) Date of Patent: Dec. 30, 2003

(54) ALUMINUM OR ALUMINUM ALLOY EXTRUDING DIE

(75) Inventors: Kazuhisa Kashiwazaki, Tokyo (JP); Hirokazu Yamaguchi, Tokyo (JP); Ryo Shoji, Tokyo (JP); Toshiyuki Kakinoki, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/117,864

(22) Filed: Apr. 4, 2002

(65) Prior Publication Data

US 2002/0189318 A1 Dec. 19, 2002

(30) Foreign Application Priority Data

Apr. 6, 2001 (JP) ..... 2001-108089
Jan. 7, 2002 (JP) ..... 2002-000766
Feb. 18, 2002 (JP) ..... 2002-039769

(51) Int. Cl.[7] ..... B21C 25/04
(52) U.S. Cl. ..... 72/269; 72/467
(58) Field of Search ..... 72/253.1, 264, 72/269, 462, 467, 700, 46, 47; 76/107.1, 107.4, 107.6

(56) References Cited

U.S. PATENT DOCUMENTS 4,571,983 A * 2/1986 Sanborn et al. ..... 72/462
4,914,796 A * 4/1990 Lioy et al. ..... 205/151
5,545,268 A * 8/1996 Yashiki et al. ..... 148/518
5,664,453 A * 9/1997 Abo et al. ..... 72/269
6,038,900 A * 3/2000 Miyasaka ..... 72/53

FOREIGN PATENT DOCUMENTS

JP 64-34504 * 2/1989 ..... 72/47
JP 02-046914 2/1990
JP 2-255213 * 10/1990 ..... 72/253.1
JP 06-315716 11/1994
JP 07-155828 6/1995
JP 08-281320 10/1996

OTHER PUBLICATIONS

The Making, Shaping and Treating of Steel, 10th Edition, US Steel, 1985, pp. 1128–1130.*

* cited by examiner

*Primary Examiner*—Ed Tolan
(74) *Attorney, Agent, or Firm*—Knobbe Martens Olson & Bear LLP

(57) ABSTRACT

There is disclosed an aluminum or aluminum alloy extruding die, which comprises Co-group alloy, Ni-group alloy, Cr-group alloy or like high temperature wear-resistant alloy coating applied by thermal spraying on a required die surface portion having been formed in the shape of a rough surface having surface roughness Rz of 5 $\mu$m or more. Preferably, after application of the alloy coating, the die is held at a temperature in the range from 500 to 800° C. for a predetermined period of time or the alloy coating surface is so roughened as to have surface roughness Rz of 10 $\mu$m or less.

8 Claims, 2 Drawing Sheets

PLATE THICKNESS: 3.5mm
CORNER R(OUTSIDE): 4mm
CORNER R(INSIDE): 3mm

PLATE THICKNESS: 12mm
CORNER R: 1mm

ALUMINUM OR ALUMINUM ALLOY EXTRUDING DIE

BACKGROUND OF THE INVENTION

1. Field of the Invention

This invention generally relates to an extruding die useful in hot-extrusion into aluminum or aluminum alloy shapes, and more particularly, to an extruding die, which is so improved as to permit production of extruded materials of higher dimensional precision, while meeting a demand for longer life.

2. Description of the Prior Art

A die serving to hot-extrude aluminum or aluminum alloy (which will be hereinafter simply referred to as Al or Al alloy) is useful under the high temperature and friction environment, and is thus limited as to its material to hot-working tool steel typically known as JIS SKD61.

However, the die made of the tool steel as described the above by itself causes the useful life to be shortened by cracking and seizure of a material to be extruded onto the die surface in the process of extruding, as well as high temperature wear or the like. The cracking, seizure and high temperature wear or the like as described the above are supposed to be factors contributing to surface folding of products and degradation of product quality inclusive of degraded dimensional precision, and the need for frequent exchange of dies also results in remarkably degraded productivity.

Various kinds of arts have been proposed in order to solve the above problems.

For instance, in Japanese Patent Laid-open No. 2-46914, there is disclosed the art of cladding a bearing part of the die with Co-group alloy.

In Japanese Patent Laid-open No. 8-281320, there is disclosed the art of applying carbide coating on a prospective die surface portion contacting Al or Al alloy.

In Japanese Patent Laid-open No. 7-155828, there is disclosed the art of applying zinc brittle-resistant coating by cladding or thermal-spraying the surface of a mandrel bridge part of the die with Ni-group alloy, Mo-group alloy, Co-group alloy or the like.

However, the above prior arts present the following problems respectively.

That is, using the art of cladding the die surface with the Co-group alloy as disclosed in Japanese Patent Laid-open No. 2-46914 controls die cracking and high temperature wear, while heat generated in the process of cladding causes the die to be locally heated to produce strain easily. The strain thus produced leads to degraded dimensional precision of extruded shapes.

Using the art of applying the carbide coating on the die as disclosed in Japanese Patent Laid-open No. 8-281320 is liable to cause the coating to peel off the die. Thus, there is the need for measures of grading the concentration of components in the range of a contact surface of the coating with the die. However, the above measures will be supposed to be variance with reality because of the need for a complicated process of applying the coating, together with high cost.

Using the art of only applying the predetermined alloy coating by thermal spraying as disclosed in Japanese Patent Laid-open No. 7-155828 does not attain sufficient adhesiveness between the alloy coating and the die, and causes the alloy coating to peel off so easily as to fail to produce the satisfactory longer life effect of the die.

SUMMARY OF THE INVENTION

It is an object of the present invention to provide an Al or Al alloy extruding die, which permits production of extruded materials of higher dimensional precision while meeting a demand for longer life of the die by preventing die cracking and high temperature wear more satisfactorily from occurring in the process of extruding, by means of applying high temperature wear-resistant alloy coating on a required portion of the die in such a manner as to permit less peeling without causing the die to produce strain.

To attain the above object, an Al or Al alloy extruding die in the first mode according to the present invention comprises Co-group alloy, Ni-group alloy, Cr-group alloy or like high temperature wear-resistant alloy coating applied by thermal spraying on a required die surface portion having been formed in the shape of a rough surface having surface roughness Rz of 5 $\mu$m or more.

In the Al or Al alloy extruding die in the first mode, an Al or Al alloy extruding die in the second mode according to the present invention is characterized in that the die is held at a temperature in the range from 500 to 800° C. for a predetermined period of time, after the above alloy coating has been applied on the above rough surface.

In the Al or Al alloy extruding die in the first mode, an Al or Al alloy extruding die in the third mode according to the present invention is characterized in that the alloy coating surface is so roughened as to have surface roughness Rz of 10 $\mu$m or less.

In the Al or Al alloy extruding die in one of the first to third modes, an Al or Al alloy extruding die in the fourth mode according to the present invention is characterized in that the thickness of the alloy coating is limited to the range from 10 $\mu$m or more to 200 $\mu$m or less.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1A:
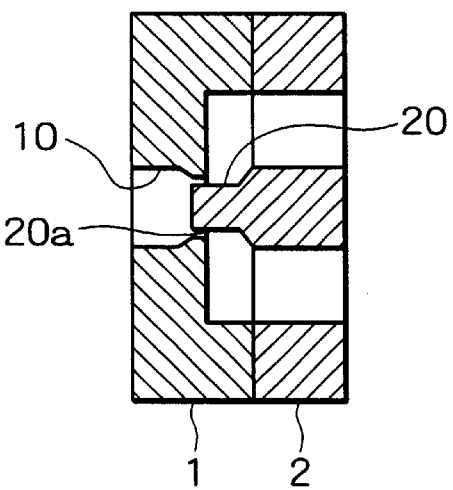
FIG. 1 illustrates one embodiment of an extruding die according to the present invention, with FIG. 1*a* of a longitudinal cross-sectional view showing the extruding die, FIG. 1*b* of a front view showing a male die segment of the die in FIG. 1*a* and FIG. 1*c* of an enlarged cross-section taken on arrows A—A in FIG. 1*b*.
Figure 1B:
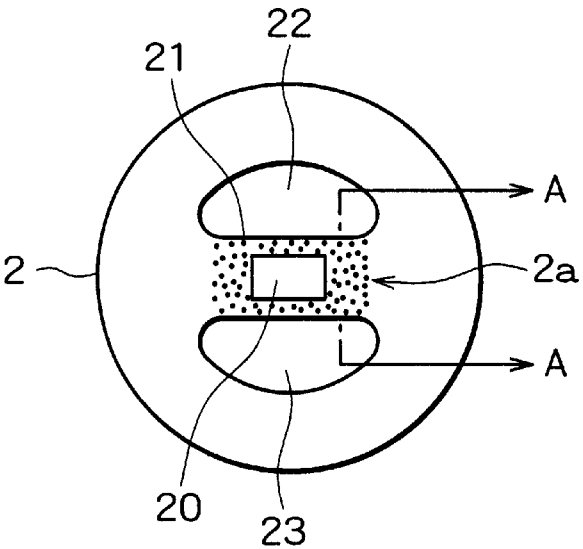
Figure 1C:
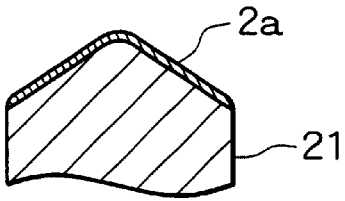

Referring to FIG. 1, reference numeral 1 denotes a female die segment having a hole 10 in the axial center, and 2 is a male die segment having a mandrel 20 projecting from the axial center of a cylindrical part. Both the female and male die segments 1, 2 are limited as to their material to tool steel called JIS SKD61.

An opening of the male die segment 2 is divided into a plurality of ports 22, 23 through a bridge 21 serving to support the mandrel 20 as one body. The circumference of the tip end of the mandrel 20 provides a bearing part 20*a*, and the bearing part 20*a* and the edge of the hole 10 of the female die segment 1 make up an orifice extending in a rectangular shape in section.

The periphery of a root portion of the mandrel 20, that is, the surface of the bridge 21 on the front side of the male die segment 2 with the mandrel 20 projecting therefrom is formed in the shape of a rough surface having surface roughness Rz of 5 μm or more by shot blasting or the like, for instance, and high temperature wear-resistant alloy coating 2*a* is applied on the rough surface by thermal spraying.

The male die segment 2 is heat-treated at a temperature in the range from 500 to 800° C. for about one hour, after the high temperature wear-resistant alloy coating 2*a* has been applied as described the above.

Preferably, a portion of the alloy coating 2*a* on the male die segment 2 is formed in the shape of a rough surface having surface roughness Rz of 10 μm or less by shot blasting, polishing or the like, after application of the above alloy coating 2*a* or the heat treatment as described the above.

Examples of preferably useful high temperature wear-resistant alloy include Co-group alloy such as an alloy consisting of 58 mass % (which will be hereinafter simply referred to as %) Co—25% Cr—15% W—2% C and an alloy consisting of 65% Co—26% Cr—6% Mo—3% Ni. Otherwise, Ni-group alloy such as an alloy consisting of 60% Ni—18% Cr—18% Co—4% Mo or Cr-group alloy and so on will be also available.

According to the Al or Al alloy extruding die in the above embodiment, the high temperature wear-resistant alloy coating 2*a* is applied on a portion easily worn by concentration of stress, that is, the root portion of the mandrel 20 and its neighboring surface of the male die segment 2. Thus, the above alloy coating 2*a* produces an effect of preventing Al or metal elements in the Al alloy from being diffused in die steel within the range of the coating portion, permitting a contribution toward control of brittle cracking in the die within the range of the coating portion.

The high temperature wear-resistant alloy coating 2*a* provides high wear resistance under the high temperature environment enough to eliminate die cracking produced by stress concentrated on a wear part and also to restrain dimensional precision from being degraded by die flexure produced by stress concentrated on the wear part.

Since the die surface to be subjected to application of the high temperature wear-resistant alloy coating 2*a* is preliminarily formed in the shape of the rough surface having surface roughness Rz of 5 μm or more, adhesiveness of the alloy coating 2*a* is so enhanced that the alloy coating 2*a* hardly peels off. Further, since the above high temperature wear-resistant alloy coating is closer in coefficient value of thermal expansion to the die steel such as JIS SKD61 than carbide coating and ceramic coating, peeling of the alloy coating 2*a* hardly occurs even though the die is heated up to a temperature of about 500° C. supposed to be an extrusion temperature.

The die, if heat-treated at a temperature in the range from 500 to 800° C. for about one hour after the alloy coating 2*a* has been applied as described the above, permits the components of the alloy coating 2*a* to be diffused into the die within the range of the coating portion, providing further enhanced adhesiveness of the alloy coating 2*a*.

Further, the alloy coating 2*a*, if so roughened as to have surface roughness Rz of 10 μm or less, produces a degrading effect of anchoring between the alloy coating and Al or Al alloy in the process of extruding the Al or Al alloy, permitting the alloy coating 2*a* to more hardly peel off.

Since the above alloy coating 2*a* is applied by thermal spraying, the die may be eliminated from thermal strain produced by subjecting the die steel within the range of the coating portion to heating partially in excess (like by cladding) during application of the alloy coating, permitting production of extruded shapes of high dimensional precision.

As a result, the extruding die according to the present invention permits production of extruded materials of higher dimensional precision, while meeting a demand for longer life of the die by preventing die cracking and high temperature wear more satisfactorily from occurring in the process of extruding.

In the extruding die according to the above embodiment, when the die surface to be subjected to application of the high temperature wear-resistant alloy coating 2*a* is formed in the shape of the rough surface, the rough surface having surface roughness Rz of less than 5 μm does not attain sufficient adhesiveness of the alloy coating 2*a*. Thus, the surface roughness Rz of the above rough surface needs to be limited to 5 μm or more. The upper limit of the surface roughness is not worth due consideration.

When the thickness of the high temperature wear-resistant alloy coating 2*a* applied by thermal spraying is less than 10 μm, the prospective effect of the alloy coating in preventing the components of a material to be extruded from being diffused in the die steel lasts only a short period of time. For that reason, the die pertinent to the above decreases its limiting extrusion output, and besides, Al or metal elements in the Al alloy will be diffused into the die steel within the range of the coating portion through existing pores in the sprayed alloy coating to produce brittle cracking. Thus, the thickness of the above alloy coating is preferably limited to 10 μm or more. While a greater thickness is supposed to be more suitable for the alloy coating by reason that the above prospective effect of the alloy coating may last a longer period of time with the increasing thickness of the alloy coating, it is to be understood that alloy coating having a thickness of more than 200 μm will easily peel off in the process of thermal spraying. As a result, the thickness of the above alloy coating 2*a* is preferably limited to the range from 10 to 200 μm.

When the die is heat-treated after the high temperature wear-resistant alloy coating 2*a* has been applied as described the above, the heat treatment at a temperature of less than 500° C. is not enough to diffuse the components of the alloy coating into the die steel. On the other hand, the heat treatment at a temperature of more than 800° C. produces the degrading strength of the die steel. Accordingly, the heating temperature for the above heat treatment needs to be limited to the range from 500 to 800° C. The most preferable heating temperature and holding time for the heat treatment are supposed to be about 700° C. and about one hour.

When the portion of the high temperature wear-resistant alloy coating 2*a* is formed in the shape of the rough surface, the rough surface having surface roughness Rz of more than 10 μm causes the alloy coating 2*a* to easily peel off under the action of the effect of anchoring between the alloy coating 2*a* and the Al or Al alloy in the process of extruding the Al or Al alloy. Thus, the surface roughness Rz of the above alloy coating 2*a* needs to be limited to 10 μm or less.

A description will now be given of different embodiments according to the present invention.

Having described the embodiment related to the hollow die, it is to be understood that the present invention is also applicable to a solid die serving to produce solid extruded shapes. When the alloy coating is partially applied on the solid die, an extrusion orifice or port of a die hole and its peripheral area of the solid die are supposed to be preferably suitable for application of the alloy coating.

While the above embodiment is limited as to application of the high temperature wear-resistant alloy coating to the mandrel root portion and its peripheral bridge surface portion on the male die segment side of the hollow die, it is to be understood that it may be more effective to apply the alloy coating according to the similar procedure on the whole surface of a prospective die portion contacting extruded Al or Al alloy, no matter whether it is the hollow die or the solid die.

A description will now be given of some experimental examples according to the present invention.

For the solid die and the hollow die both made of SKD61 steel as base metal, seven kinds of dies (i.e., four kinds of solid dies and three kinds of hollow dies) as Comparative examples 1 to 7, as well as eleven kinds of dies (i.e., five kinds of solid dies and six kinds of hollow dies) as Examples 8 to 18 were produced on an experimental basis.

To all the dies, coating was applied on a prospective die surface portion contacting extruded Al alloy by thermal-spraying the above prospective die surface portion with Co-group alloy consisting of 58% Co—25% Cr—15% W—2% C.

For each of the dies as Comparative examples 1 to 6 except for Comparative example 7, the above alloy coating was applied on the die surface portion without pre-treating the above die surface portion by shot blasting into a surface having surface roughness Rz of 5 μm or more. For each of the dies as Comparative examples 3, 4 among Comparative examples 1 to 6, the heat treatment at a temperature of 700° C. for one hour was put into effect after application of the alloy coating. On the other hand, for each of the dies as Comparative examples 4, 5, the alloy coating surface was so roughened as to have surface roughness Rz of 7.5 μm or 8.2 μm by shot blasting with fine grain-sized grits after application of the alloy coating.

The thickness of the Co-group alloy coating was limited to 218 μm and 231 μm respectively for the dies as Comparative examples 6, 7.

For each of the dies as Examples 8 to 18, the alloy coating was applied on the die surface portion having been pre-treated by shot blasting into a surface having surface roughness Rz in the range from 9.1 to 11.3 μm. For each of the dies (i.e., two kinds of solid dies and two kinds of hollow dies) as Examples 8 to 11 among Examples 8 to 18, the heat treatment was not put into effect after application of the alloy coating. On the other hand, for each of the remaining dies as Examples 12 to 18, the heat treatment at a temperature of 700° C. for one hour was put into effect after application of the alloy coating. For each of the dies (i.e., one solid die and one hollow die) as Examples 10, 11 among Examples 8 to 11 with no heat treatment after application of the alloy coating, as well as each of the dies (i.e., two kinds of solid dies and three kinds of hollow dies) as Examples 14 to 18 among Examples 12 to 18 with the heat treatment after application of the alloy coating, the alloy coating surface was so roughened as to have surface roughness Rz in the range from 6.8 to 8.6 μm by shot blasting with fine grain-sized grits.

The thickness of the Co-group alloy coating was limited to 4.1 μm for the die as Example 16, and to 181 μm and 173 μm for the dies as Examples 17,18.

Figure 2B:
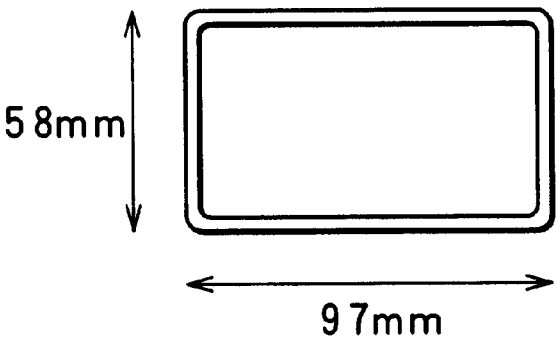
FIG. 2 illustrates extruded shapes produced by dies according to Examples and Comparative examples, with FIG. 2*a* of a cross-sectional view showing a solid extruded shape and FIG. 2*b* of a cross-sectional view showing a hollow extruded shape.
Figure 2A:
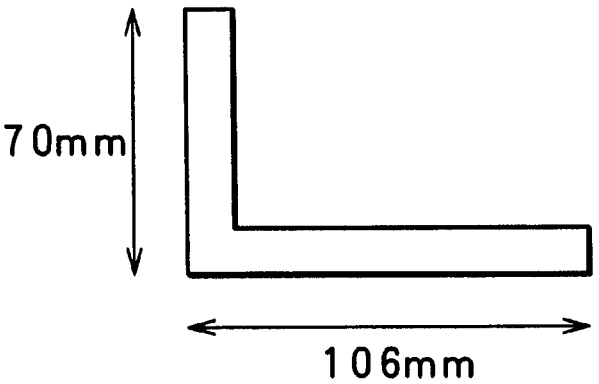

The extruded shapes having sections and dimensions as shown in FIGS. 2*a* and 2*b* were produced according to the following conditions using the above dies for extrusion of materials including 2000- and 7000-group alloys particularly supposed to have higher frequency at which die cracking occurs.

Extrusion Conditions

Solid extrusion
- Material: 2024
- Billet diameter: ϕ219 mm
- Extrusion rate: 2 m/min.
- Billet temperature: 430° C.

Hollow extrusion
- Material: 7N01
- Billet diameter: ϕ219 mm
- Extrusion rate: 5 m/min.
- Billet temperature: 450° C.

In the above extrusion process, the aluminum alloy adhered to the die was dissolved with caustic soda every extrusion output of 500 Kg to check whether or not die cracking and peeling of the alloy coating occurred. Then, extrusion was discontinued whenever the die cracking and the peeling of the alloy coating were found.

Table 1 shows the experimental results all together as follows.

Referring to the results shown in Table 1, according to the dies as Comparative examples 1 to 5, since surface roughness Rz of each die surface portion was in the range from 2.9 to 3.9 μm because of no shot blasting before thermal spraying with the high temperature wear-resistant alloy, peeling of the alloy coating was found whenever extrusion output reached 500 Kg, no matter whether or not the heat treatment was put into effect after application of the alloy coating and whether or not the alloy coating surface was so roughened as to have surface roughness Rz of 10 μm or less.

According to the dies as Comparative examples 6, 7, since the coating thickness was more than 200 μm, peeling of the alloy coating had been already found before thermal spraying with the Co-group alloy, so that the experiment was concluded without proceeding to extrusion.

On the other hand, according to the dies as Examples 8, 9, since the alloy was thermally sprayed upon the die surface portion having been pre-treated by shot blasting into the surface having surface roughness Rz of 9.6 μm or 10.2 μm for application of the alloy coating without any heat treatment nor roughening the alloy coating surface so as to have surface roughness Rz of 10 μm or less, peeling of the alloy coating was not started until the extrusion output reached 7.5 ton or 6.5 ton.

According to the dies as Examples 10, 11, since the alloy was thermally sprayed upon the die surface portion having been pre-treated by shot blasting into the surface having surface roughness Rz of 9.8 μm or 10.1 μm for application of the alloy coating, which was then so roughened as to have surface roughness of 7.1 μm or 8.1 μm without any heat treatment, neither die cracking nor peeling of the alloy coating was found even after the extrusion output had exceeded 10 ton. (However, the limiting extrusion output remains unexplained since the experiment on extrusion was discontinued whenever the extrusion output reached 10 ton.) The same result as Examples 10, 11 was given to the dies as Examples 12, 13 since the alloy was thermally sprayed upon the die surface portion having been pre-treated by shot blasting into the surface having surface roughness Rz of 9.1 μm or 9.7 μm for application of the alloy coating, which was then heat-treated, and also to the dies as Examples 14, 15 since the alloy was thermally sprayed upon the die surface portion having been pre-treated by shot blasting into the surface having surface roughness of 9.3 μm or 10.0 μm for application of the alloy coating, which was then heat-treated and besides was so roughened as to have surface roughness Rz of 8.6 μm or 7.4 μm.

According to the dies as Examples 17, 18, which were subjected to substantially similar treatment to the dies as Examples 14, 15, except for application of alloy coating having a larger thickness within the range of 200 μm or less, the alloy coating was so sound that neither peeling of the alloy coating nor die cracking was found even after the extrusion output had exceeded 10 ton. On the other hand, according to the die as Example 16, which was subjected to substantially similar treatment to the dies as Examples 14, 15, the life of the die was made longer than that of each die as Comparative examples, while die cracking was found whenever the extrusion output reached 6.1 ton, because of its alloy coating having a thickness as small as 4.1 μm.

Further, as the result of measurement on the dimensional precision of the extruded products according to the dies as Examples every extrusion output of 500 Kg, any product without the range of JIS special class was not found at all.

since the above high temperature wear-resistant alloy coating is closer in coefficient value of thermal expansion to the die steel such as JIS SKD61 than the carbide coating and the ceramic coating, peeling of the alloy coating hardly occurs even though the die is heated up to the temperature close to 500° C. supposed to be the extrusion temperature.

Since the above alloy coating is applied by thermal spraying, the die may be eliminated from thermal strain produced by subjecting the die steel within the range of the coating portion to heating partially in excess (like by cladding) during application of the alloy coating, permitting production of the extruded shapes of high dimensional precision.

As a result, the extruding die according to the present invention permits production of extruded materials of higher dimensional precision, while meeting a demand for longer life of the die by preventing die cracking and high temperature wear more satisfactorily from occurring in the process of extruding.

In the extruding die in claim 1 according to the present invention, in accordance with the extruding die in claim 2 according to the present invention, the die is held at a

TABLE 1

(Results of extrusior and evaluation)

| Class and No. | | Shot blasting | Die surface roughness Rz (μm) | Coating thickness (μm) | Heat treatment after thermal spraying | Coating surface roughness (μm) | Alloy to be extruded | Product shape | Extrusion output (ton) | Peeling of coating or like | Die cracking |
|---|---|---|---|---|---|---|---|---|---|---|---|
| Comparative example | 1 | None | 3.9 | 17.2 | None | 15.1 | 2024 | Solid | 0.5 | Occurred | None |
| | 2 | None | 3.2 | 18.6 | None | 16.2 | 7N01 | Hollow | 0.5 | Occurred | Occurred |
| | 3 | None | 3.1 | 18.3 | Done | 15.7 | 2024 | Solid | 0.5 | Occurred | None |
| | 4 | None | 3.6 | 16.9 | Done | 7.5 | 7N01 | Hollow | 0.5 | Occurred | Occurred |
| | 5 | None | 2.9 | 17.8 | None | 8.2 | 2024 | Solid | 0.5 | Occurred | None |
| | 6 | None | 3.2 | 218.0 | — | — | — | Solid | — | — | — |
| | 7 | Done | 10.4 | 231.0 | — | — | — | Hollow | — | — | — |
| Example | 8 | Done | 9.6 | 16.8 | None | 14.8 | 2024 | Solid | 7.5 | Occurred | None |
| | 9 | Done | 10.2 | 18.9 | None | 15.5 | 7N01 | Hollow | 6.5 | Occurred | None |
| | 10 | Done | 9.8 | 17.7 | None | 7.1 | 2024 | Solid | 10 | None | None |
| | 11 | Done | 10.1 | 19.1 | None | 8.1 | 7N01 | Hollow | 10 | None | None |
| | 12 | Done | 9.1 | 18.6 | Done | 15.8 | 2024 | Solid | 10 | None | None |
| | 13 | Done | 9.7 | 17.9 | Done | 13.9 | 7N01 | Hollow | 10 | None | None |
| | 14 | Done | 9.3 | 17.7 | Done | 8.6 | 2024 | Solid | 10 | None | None |
| | 15 | Done | 10.0 | 19.0 | Done | 7.4 | 7N01 | Hollow | 10 | None | None |
| | 16 | Done | 9.8 | 4.1 | Done | 7.3 | 7N01 | Hollow | 6.1 | None | Occurred |
| | 17 | Done | 10.9 | 181.0 | Done | 6.8 | 2024 | Solid | 10 | None | None |
| | 18 | Done | 11.3 | 173.0 | Done | 7.3 | 7N01 | Hollow | 10 | None | None |

In accordance with the extruding die in claim 1 according to the present invention, the Co-group alloy, Ni-group alloy, Cr-group alloy or like high temperature wear-resistant alloy coating is applied on the required portion of the die surface by thermal spraying. Thus, the alloy coating produces the effect of preventing Al or metal elements in the Al alloy from being diffused into the die steel within the range of the coating portion, permitting a contribution toward control of brittle cracking in the die within the range of the coating portion.

The high temperature wear-resistant alloy coating provides high wear resistance under the high temperature environment enough to eliminate die cracking produced by stress concentrated on the wear part, and also to restrain dimensional precision from being degraded by die flexure produced by stress concentrated on the wear part.

Since the die surface to be subjected to application of the high temperature wear-resistant alloy coating is formed in the shape of the rough surface having surface roughness Rz of 5 μm or more, adhesiveness of the alloy coating may be so enhanced that the alloy coating hardly peels off. Further, temperature in the range from 500 to 800° C. for a predetermined period of time, after the alloy coating has been applied on the rough surface. Thus, the components of the alloy coating may be diffused into the die steel within the range of the coating portion, providing so enhanced adhesiveness of the alloy coating as to meet a demand for remarkably longer life of the die.

In the extruding die in claim 1 according to the present invention, in accordance with the extruding die in claim 3 according to the present invention, the alloy coating surface is so roughened as to have surface roughness Rz of 10 μm or less, after application of the alloy coating. Thus, the effect of anchoring between the Al or Al alloy and the alloy coating will be degraded in the process of extruding the Al or the Al alloy, permitting the alloy coating to more hardly peel off. Thus, the life of the die may be further made longer.

In the extruding die in claim 1 according to the present invention, in accordance with the extruding die in claim 4 according to the present invention, the thickness of the alloy coating is limited to 10 μm or more. Thus, the prospective effect of the coating in preventing the components of the material to be extruded from being diffused into the die steel may last a longer period of time, so that the die may increase its limiting extrusion output, and besides, brittle cracking may be prevented from occurring even if the components of the material to be extruded are diffused into the die steel through the existing pores in the sprayed coating. The thickness of the alloy coating is also limited to 200 μm or less, thus preventing the alloy coating from peeling off during thermal-spraying with the alloy.

What is claimed is:

1. An aluminum or aluminum alloy extruding die, corn rising a high temperature wear-resistant alloy coating applied by thermal spraying on a required die surface portion having been formed into the shape of a rough surface having surface roughness Rz of 5 μm or more, wherein the surface of said alloy coating is so roughened as t have surface roughness Rz of 10 μm or less.

2. The aluminum or aluminum alloy extruding die of claim 1, wherein the high temperature wear-resistant alloy coating is selected from at least one of the following: Co-group alloy, Ni-group alloy, or Cr-group alloy.

3. An aluminum or aluminum alloy extruding die, comprising a high temperature wear-resistant alloy coating applied by thermal spraying on a required die surface portion having been formed into the shape of a rough surface having surface roughness Rz of 5 μm or more, wherein said die is held at a temperature in a range of 500 to 800° C. for a predetermined period of time, and the surface of said alloy coating is so roughened as to have surface roughness Rz of 10 μm or less.

4. The aluminum or aluminum alloy extruding die of claim 3, wherein the high temperature wear-resistant alloy coating is selected from at least one of the following: Co-group alloy, Ni-group alloy, or Cr-group alloy.

5. An aluminum or aluminum alloy extruding die, comprising a high temperature wear-resistant alloy coating having a thickness of 10 to 200 μm and applied by thermal spraying on a required die surface portion having been formed into the shape of a rough surface having surface roughness of 5 μm or more, wherein the surface of aid alloy coating is so roughened as to have surface roughness Rz of 10 μm or less.

6. The aluminum or aluminum alloy extruding die of claim 5, wherein the high temperature wear-resistant alloy coating is selected from at least one of the following: Co-group alloy, Ni-group alloy, or Cr-group alloy.

7. An aluminum or aluminum alloy extruding die comprising a high temperature wear-resistant alloy coating having a thickness of 10 to 200 μm and applied by thermal spraying on a required die surface portion having been formed in the shape of a rough surface having surface roughness Rz of 5 μm or more, wherein said die is held at a temperature in a range of 500 to 800° C. for a predetermined period of time, and the sur ace of said alloy coating is so roughened as to have surface roughness Rz of 10 μm or less.

8. The aluminum or aluminum alloy extruding die of claim 7, wherein the high temperature wear-resistant alloy coating is selected from at least one of the following: Co-group alloy, Ni-group alloy, or Cr-group alloy.

* * * * *